US006149141A

United States Patent [19]

Birdsell et al.

[11] Patent Number: 6,149,141

[45] Date of Patent: Nov. 21, 2000

[54] PORTABLE EVAPORATIVE HUMIDIFIER APPARATUS

[75] Inventors: Walter Birdsell, Marlborough; John Longan, Shrewsbury, both of Mass.

[73] Assignee: Honeywell Inc., Minneapolis, Minn.

[21] Appl. No.: 09/216,039

[22] Filed: Dec. 18, 1998

[51] Int. Cl.[7] ..... B01F 3/04

[52] U.S. Cl. ..... 261/100; 261/106; 261/DIG. 41

[58] Field of Search ..... 261/29, 36.1, 97, 261/98, 94, 100, 103, 106, DIG. 41

[56] References Cited

U.S. PATENT DOCUMENTS 3,075,750 1/1963 Goettl ..... 261/106
4,672,820 6/1987 Goettl ..... 261/106
5,162,088 11/1992 Peng et al. ..... 261/29
5,483,616 1/1996 Chiu et al. ..... 392/406

*Primary Examiner*—C. Scott Bushey
*Attorney, Agent, or Firm*—John E. Toupal; Harold G. Jarcho

[57] ABSTRACT

A humidifier including a housing defining an air inlet, an air outlet, an air flow path between the inlet and outlet and a liquid reservoir; a blower system for producing air flow between the inlet and the outlet; and a retainer removably mounted in the housing and shaped and arranged to support a liquid absorbent evaporator pad in the air flow path. Also included is an ejector mechanism movable relative to the retainer and operable to eject the evaporator pad from the retainer means. The ejector mechanism simplifies replacement of a dirt clogged evaporator pad.

21 Claims, 10 Drawing Sheets

PORTABLE EVAPORATIVE HUMIDIFIER APPARATUS

BACKGROUND OF THE INVENTION

This invention relates generally to an evaporative humidifier device and, more particularly, to an evaporator device utilizing a liquid absorbing element to provide humidification.

Evaporator devices are used extensively to enhance personal comfort by increasing the level of humidity in an enclosed environment. They can function additionally to provide cooling in many hot, dry regions. One well known type of evaporative humidifier employs absorbing wick elements that produce by capillary action liquid flow from a reservoir to wick portions disposed in a path of airflow provided by an electrical blower. One deficiency of wick type evaporators results from the inability of wick elements to draw liquid beyond a maximum height of about six inches. Because of this factor, the effective airflow output of wick type evaporators in cubic feet per minute (CFM) has been limited. Another problem associated with such evaporative humidifiers stems from a tendency of the evaporative elements to become clogged by particles entrained in the circulated air. Once they are saturated with dirt particles, the evaporative elements limit output and must be replaced in a procedure which is both messy and cumbersome.

The object of this invention, therefore, is to provide an improved evaporative humidifier having an easily replaced evaporator element.

SUMMARY OF THE INVENTION

The invention is a humidifier including a housing defining an air inlet, an air outlet, an air flow path between the inlet and outlet and a liquid reservoir; a blower system for producing air flow between the inlet and the outlet; and a retainer removably mounted in the housing and shaped and arranged to support a liquid absorbent evaporator pad in the air flow path. Also included is an ejector mechanism movable relative to the retainer and operable to eject the evaporator pad from the retainer means. The ejector mechanism simplifies replacement of a dirt clogged evaporator pad.

According to one feature of the invention, the retainer includes a porous receptacle arranged to pass air circulating in the air flow path and defining air porous side walls, an open upper end for receiving the evaporator pad, and a bottom portion for supporting the evaporator pad. The receptacle can be easily removed for pad replacement but does not restrict air flow.

According to another feature of the invention, the ejector mechanism is mounted in the receptacle for reciprocating movement in a direction between the bottom portion and the open upper end. The ejector engages and forcibly ejects the pad during a replacement operation.

According to still another feature of the invention, the ejector mechanism defines an ejector surface disposed to engage a bottom surface of the evaporator pad, and a handle manipulatable to produce the reciprocating movement. The features facilitate the pad replacement operation.

According to yet another feature of the invention, the ejector surface is substantially co-extensive with the bottom portion of the receptacle. The co-extensive surface desirably provides uniform removal force to the evaporator pad.

According to a further feature of the invention, the receptacle has co-axial inner and outer cylindrical side walls defining an annular cavity with an open upper end for receiving an annular evaporator pad and a bottom portion for supporting the evaporator pad. The annular receptacle permits the use of an efficient evaporator pad.

According to a further feature of the invention, the air flow path includes an axial section at least partially defined by the inner cylindrical side wall, and a transverse section communicating with the outer cylindrical side wall. This feature enhances the operating efficiency.

According to still another feature of the invention the bottom portion is an annular bottom wall extending between bottom edges of the inner and outer side walls. The annular bottom provides a stable base for the pad and ejector mechanism.

According to important features of the invention, the ejector mechanism includes an annular plate supported by the bottom wall and movable toward the open end; the outer side wall defines diametrically spaced apart first and second slots; a first handle is secured to the plate and extends through the first slot, and a second handle is secured to the plate and extends through the second slot. The handles facilitate ejection of the pad from the annular receptacle.

According to other important features of the invention, the bottom wall defines circumferentially spaced apart openings, and the plate defines circumferentially spaced apart apertures aligned with the openings. The openings and apertures increase air flow through the evaporator pad.

According to still other important features of the invention, each of the inner and outer side walls includes an annular upper rim; and a plurality of circumferentially spaced apart, substantially vertical members extending between the upper rim and the bottom wall; and the inner side wall has a height substantially shorter than the outer side wall. These features reduce holding force on the evaporator pad during the ejection process.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
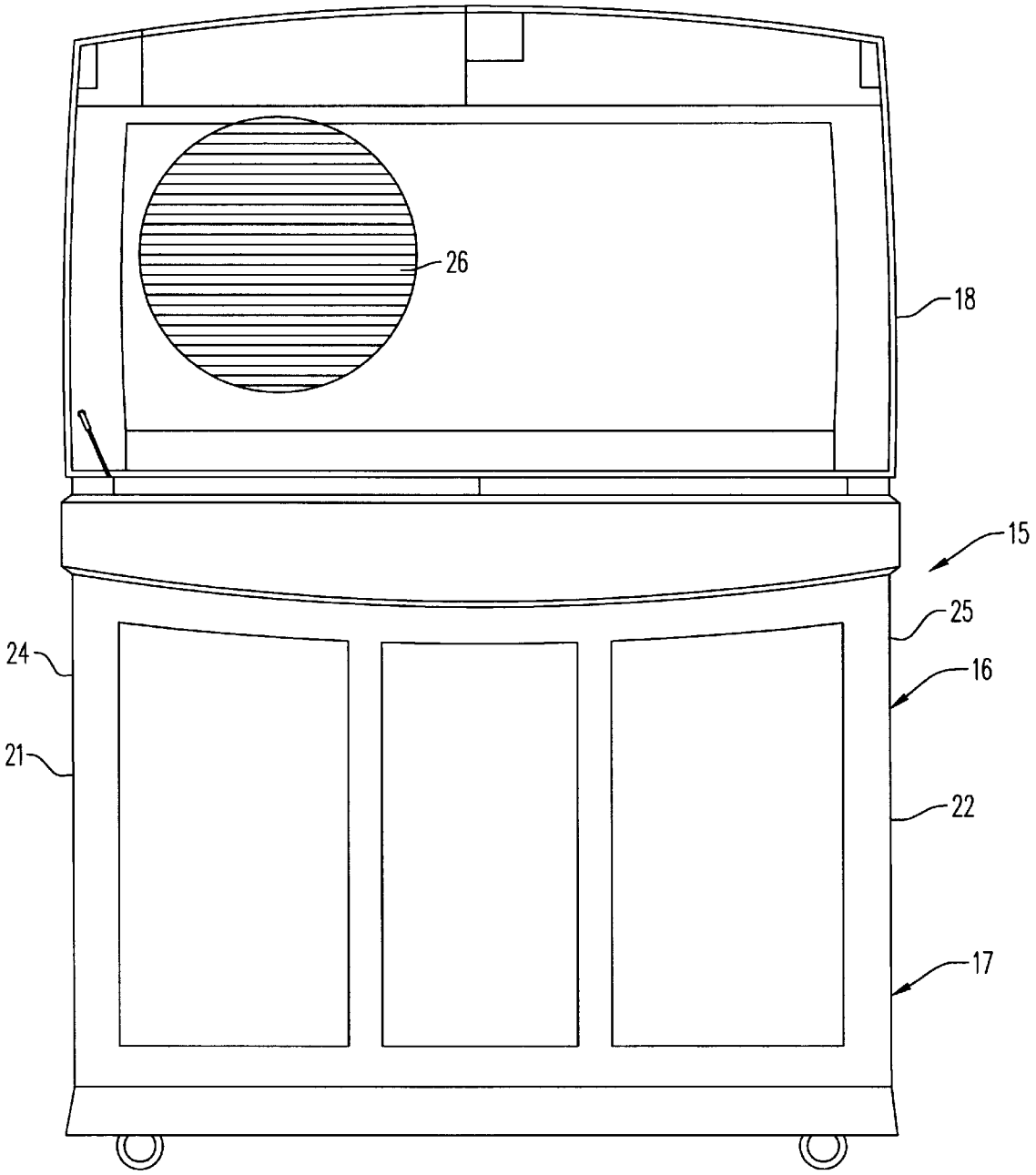
FIG. 1 is a front elevational view of a portable evaporative humidifier according to the invention.
Figure 2:
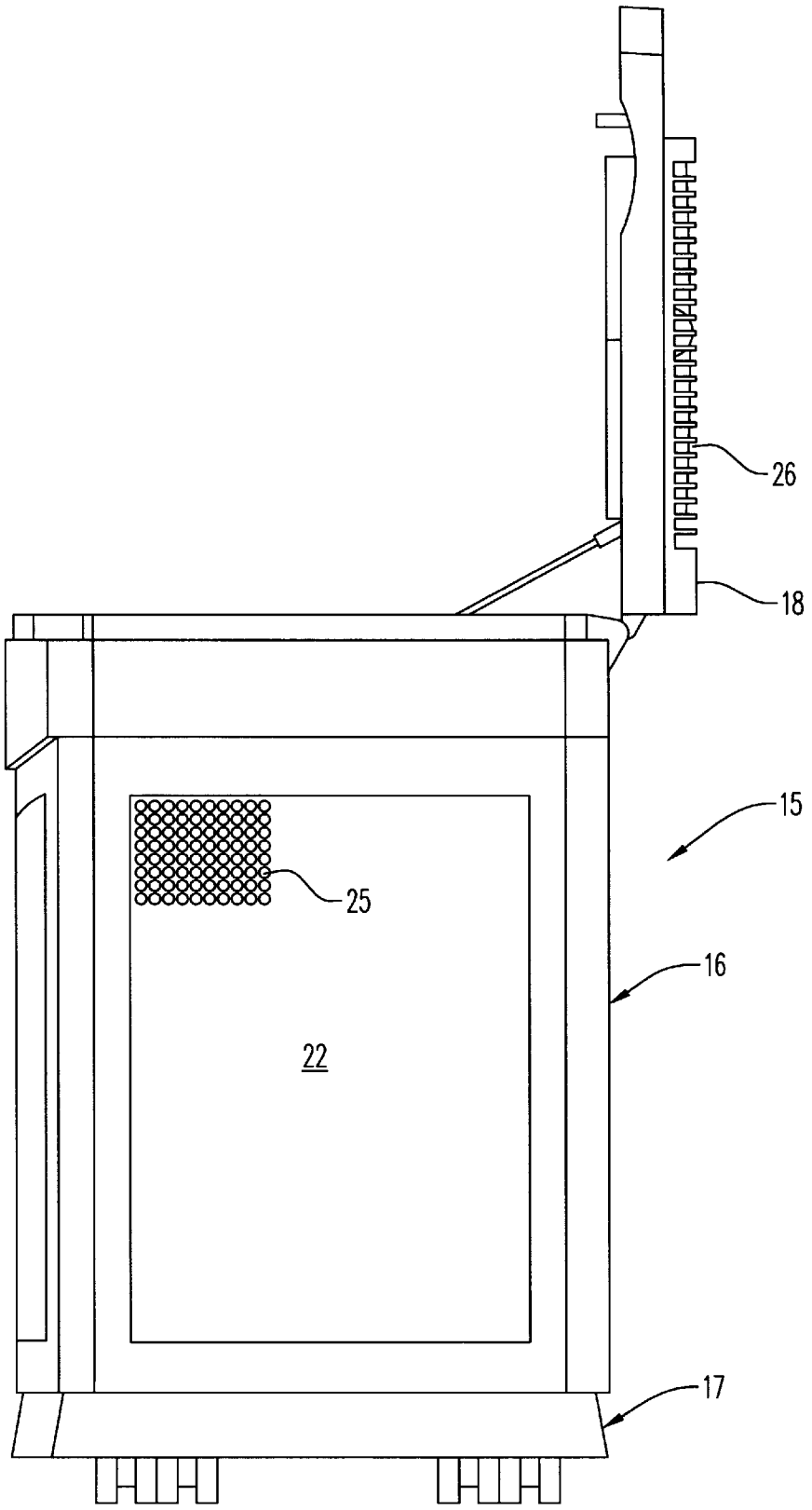
FIG. 2 is a side elevational view of the humidifier shown in FIG. 1.

An evaporative humidifier 15 includes a housing 16 formed by a portable base unit 17 and a hinged cover 18 illustrated in FIGS. 1 and 2. Defined by side walls 21, 22 of the housing 16 are, respectively, air inlets 24, 25. Another inlet 20 is formed in a rear wall of the housing 16 while an air outlet 26 is formed in the cover 18. Also defined by the housing 16 is an air flow path 28 between the inlets 20, 24, and 25 and the outlet 26 and described in greater detail hereinafter.

Figure 3:
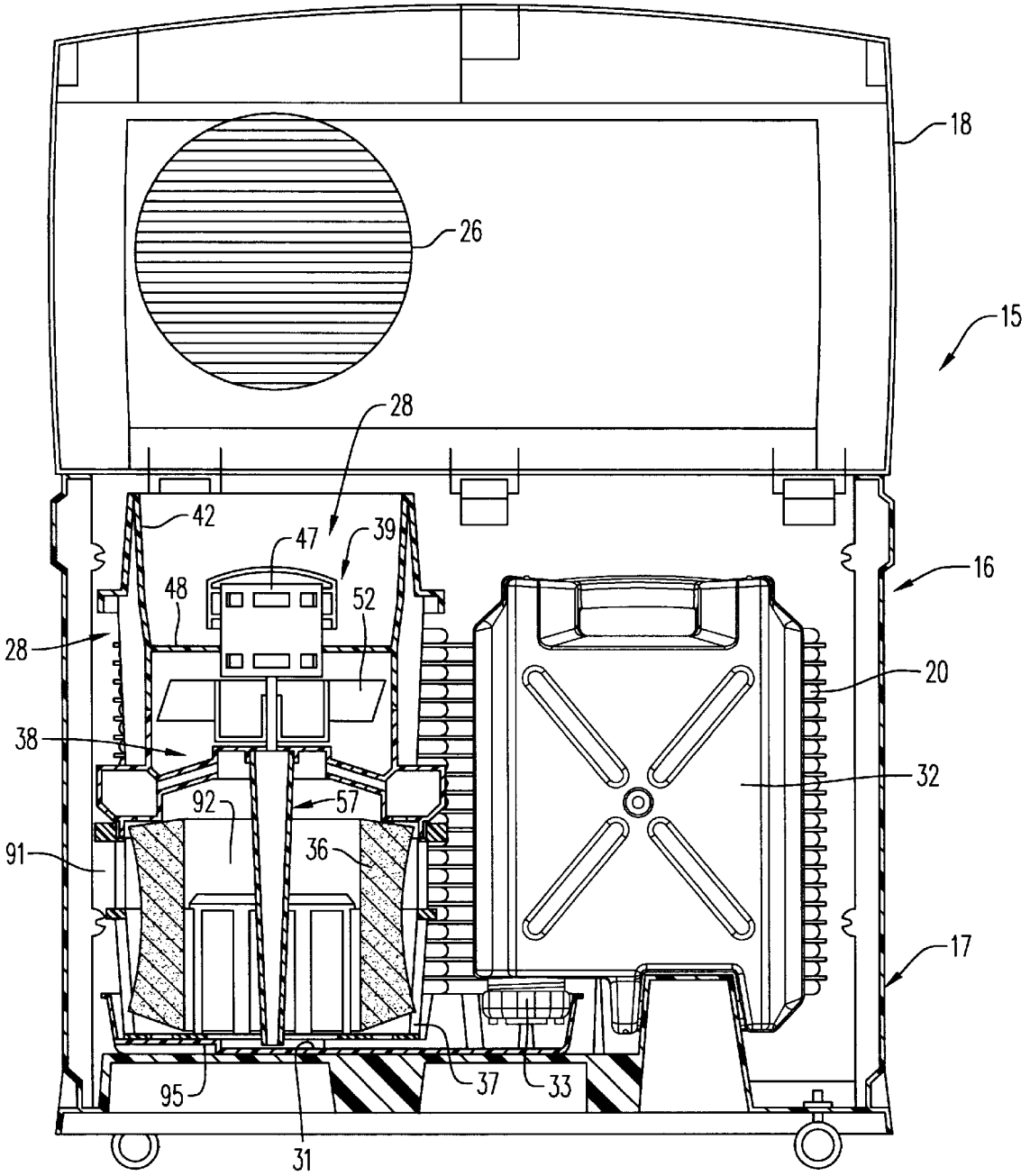
FIG. 3 is a cross-sectional view of the humidifier shown in FIGS. 1 and 2.
Figure 4:
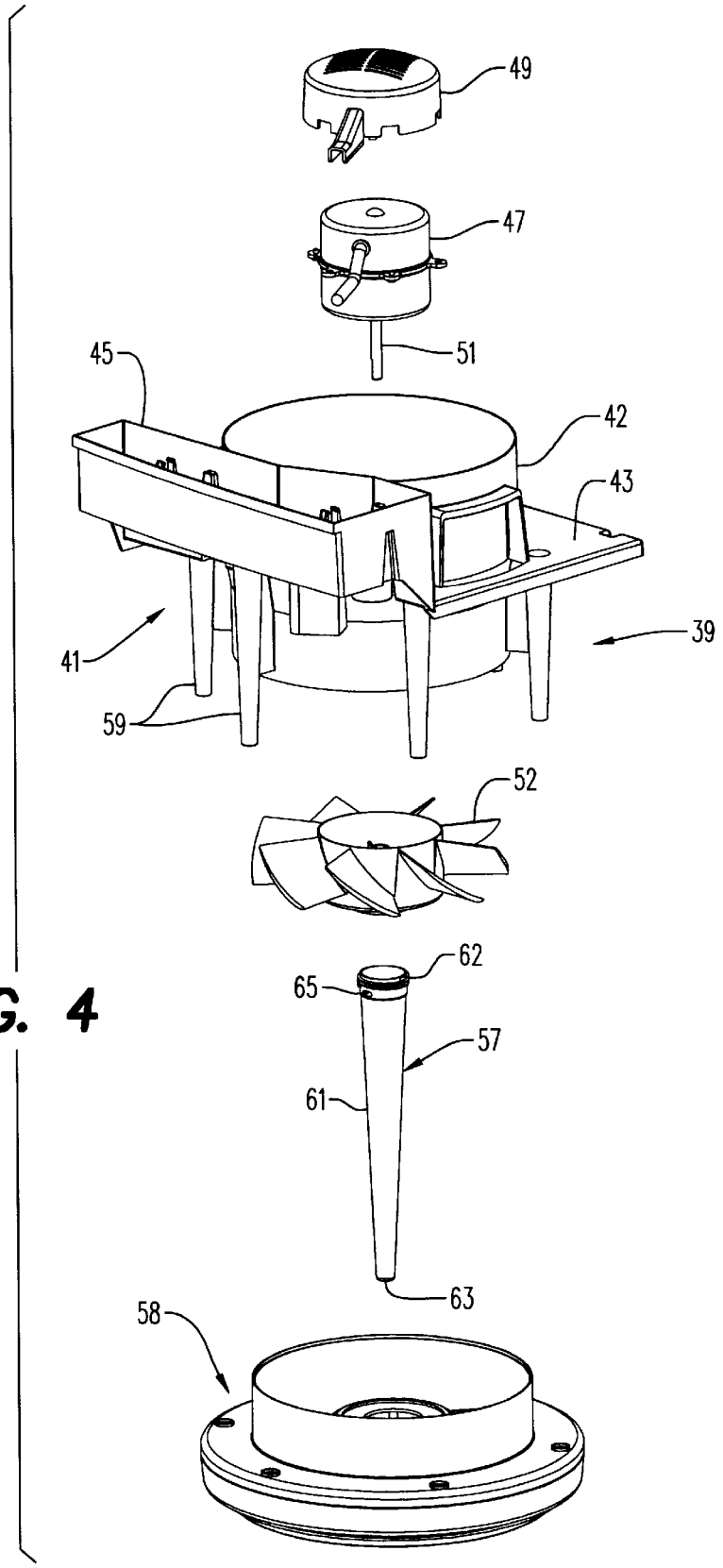
FIG. 4 is an exploded view of an air blower and water distribution system of the humidifier shown in FIG. 3.

As shown in FIG. 3, a bottom portion of the base unit 17 defines a reservoir 31 and supports a liquid supply tank 32 which maintains a given liquid level therein. A bottom wall portion of the supply tank 32 defines a water fill opening closed by a cap 33 which retains a valve (not shown) providing a controlled liquid flow from the tank 32 to the reservoir 31. The cap and valve structure 33 is conventional and can be, for example, of the type shown in U.S. Pat. No. 5,483,616. Also, mounted in the base unit 17 above the reservoir 31 is a liquid absorbent evaporator pad 36, a retainer receptacle 37 for the evaporator pad 36, and a liquid distribution system 38 for circulating water from the reservoir 31 to the evaporator pad 36 as described below. An air blower system 39 can be energized to produce air flow through the air flow path 28 between the inlets 20, 24, and 25 and the outlet 26.

Figure 5:
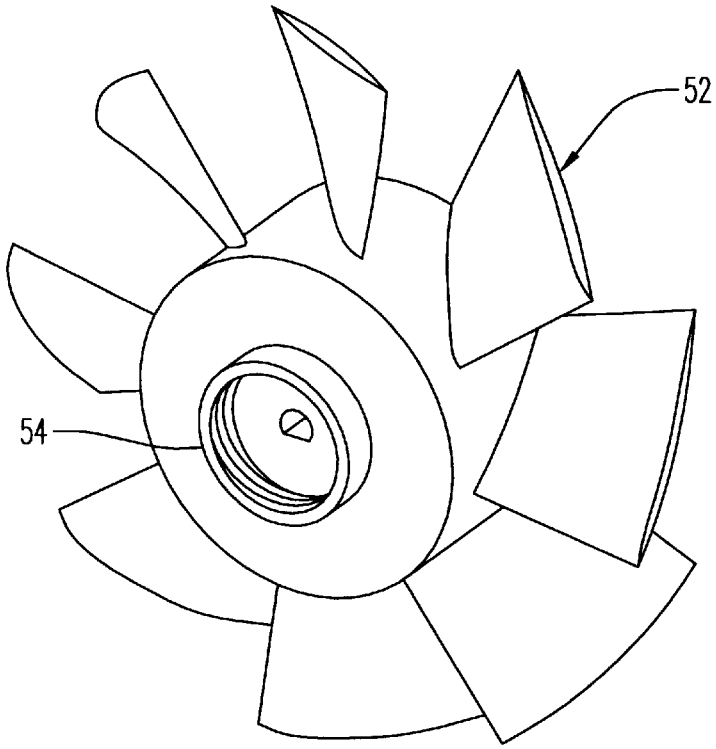
FIG. 5 is a perspective view of a fan blade used in the air blower system of FIG. 3.

The liquid distribution and blower systems 38, 39 are shown in greater detail in FIGS. 4–8. Supporting the systems 38, 39 in the housing 16 is a mounting unit 41 (FIG. 4) having a hollow tubular portion 42 and transversely extending, supporting flange portion 43. Also supported by the flange portion 43 is a case 45 for conventional electrical controls (not shown). The blower system 39 includes an electric motor 47 mounted on a shoulder flange projecting inwardly from the tubular portion 42. Projecting from a lower end of the motor 47 is a rotatable output shaft 51 while an upper end is covered by a motor cap 49. A fan blade 52 is rotatably coupled to the output shaft 51. As shown in FIG. 5, an internally threaded sleeve 54 projects axially from the bottom of the fan blade 52.

The water distribution system 38 includes an inverted centrifugal pump element 57 engaged with the threaded sleeve 54 of the fan blade 52 and an annular liquid distribution assembly 58 surrounding the pump element 57 and secured to the mounting unit 41 by a plurality of downwardly projecting posts 59.

Figure 6:
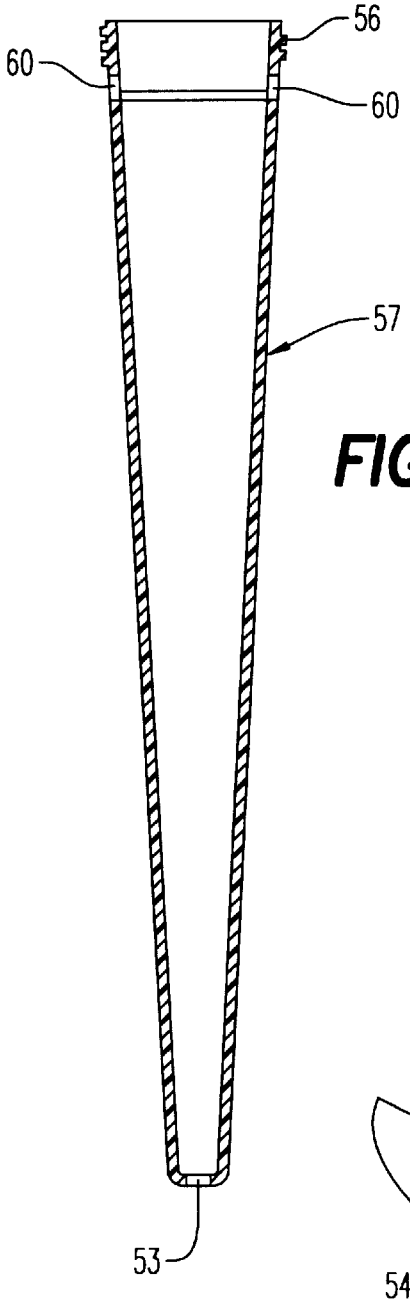
FIG. 6 is a pump element used in the water distribution system of FIG. 3.

As shown in FIG. 6, the pump element 57 is an inverted, hollow cone having an externally threaded upper end 56 for engaging the sleeve 54 of the fan blade 52 and a lower end defining an intake orifice 53. Also defined in an upper portion of the cone 57 below the threaded portion 56 are a pair of diametrically opposed discharge orifices 60. The intake orifice 53 is positioned in the reservoir 31 as shown in FIG. 3. In response to energization of the motor 47, the cone pump 57 rotates to produce centrifugal forces which draw liquid through the intake orifice 53 for discharge through the discharge orifices 60.

Figure 7:
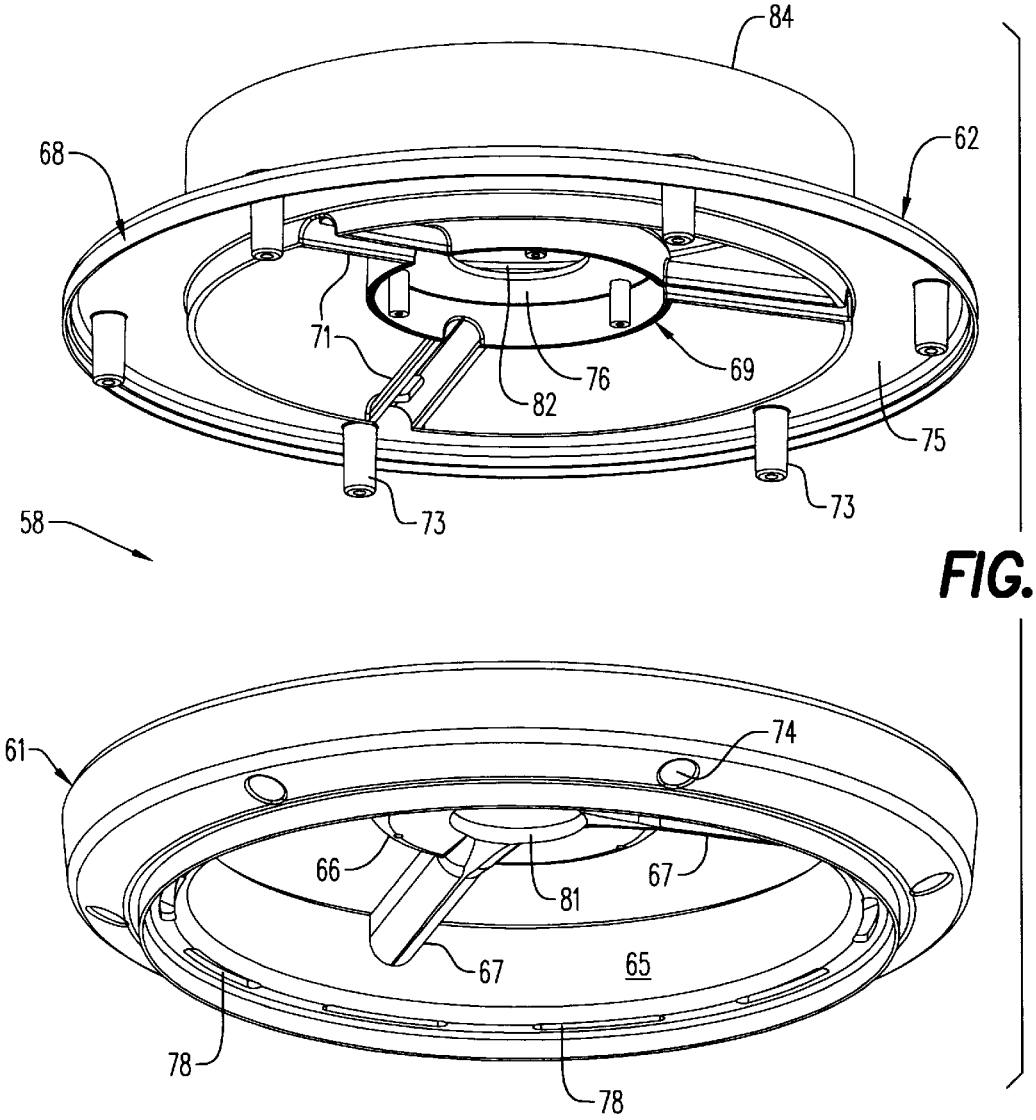
FIG. 7 is an exploded perspective view of a portion of the water distribution system shown in FIG. 3.
Figure 8:
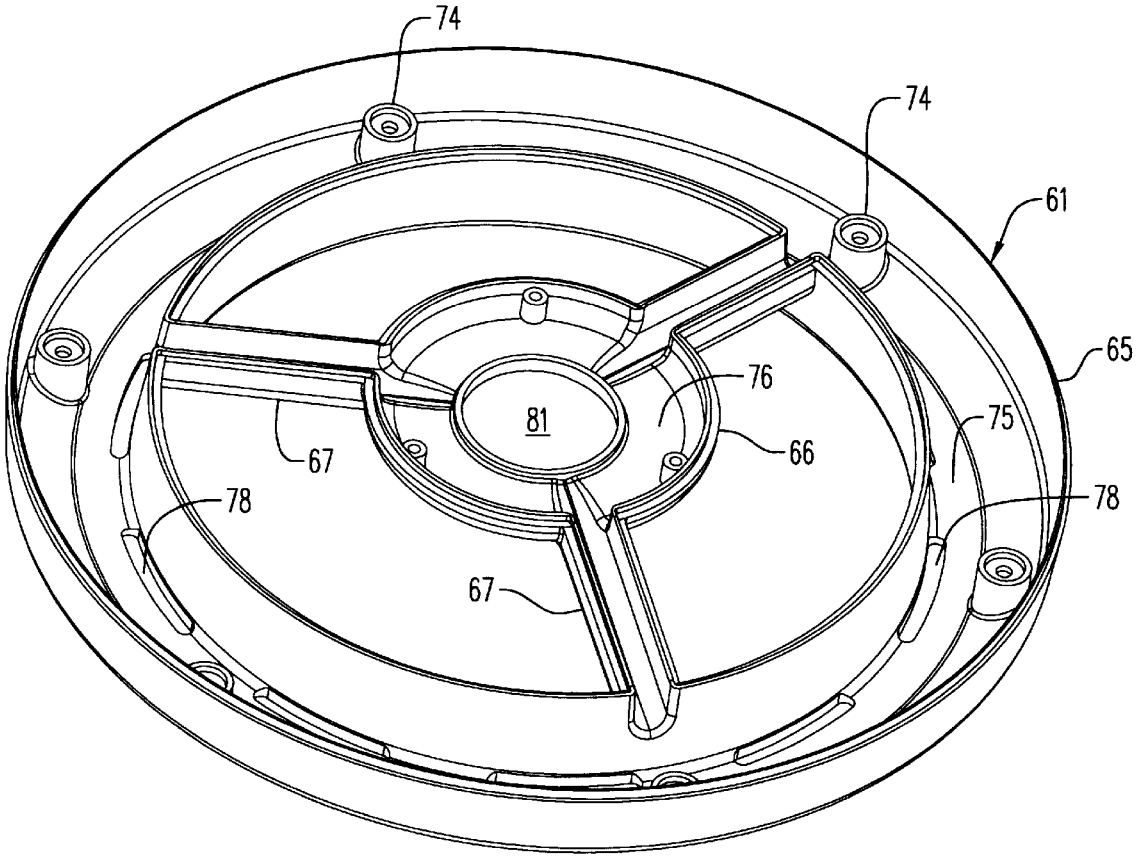
FIG. 8 is a top perspective view of a base portion of the distribution system shown in FIG. 7.

As shown in FIGS. 7 and 8, the liquid distribution assembly 58 is formed by a base member 61 and an engaged cover member 62. The base member 61 includes an annular, outer cup portion 65 and a coaxial, annular inner cup portion 66 joined by a plurality of radially extending, upwardly opening channel portions 67. Similarly, the cover member 62 includes an annular, inverted outer cup portion 68 and a coaxial, annular inverted inner cup member 69 joined by a plurality of radially projecting, downwardly opening channels 71. During assembly of the distribution unit 58, a plurality of studs 73 projecting downwardly from the outer cup portion 68 of the cover member 62 are received by posts 74 in the outer cup portion 65 of the base member 61. After assembly of the base and cover members 61, 62 the outer cup portions 65, 68 form an annular vessel 75, the inner cup portions 66, 69 form an annular, closed chamber 76, and the mated channels 67, 71 form a plurality of radially projecting tubes providing liquid communication between the closed chamber 76 and the annular vessel 75. A plurality of circumferentially spaced apart and uniformly distributed slotted openings 78 are formed in the lower surface of the outer cup portion 65 of the base member 61. Defined by the inner cup portions 66, 69 are, respectively, aligned central openings 81, 82 that accommodate passage of the conical pump 57 shown in FIG. 3. Also, a sleeve 84 projecting upwardly from the outer cup portion 68 of the cover member 62 is dimensioned for closely fitting over the tubular portion 42 of the mounting unit 41 as also shown in FIG. 3.

Figure 10:
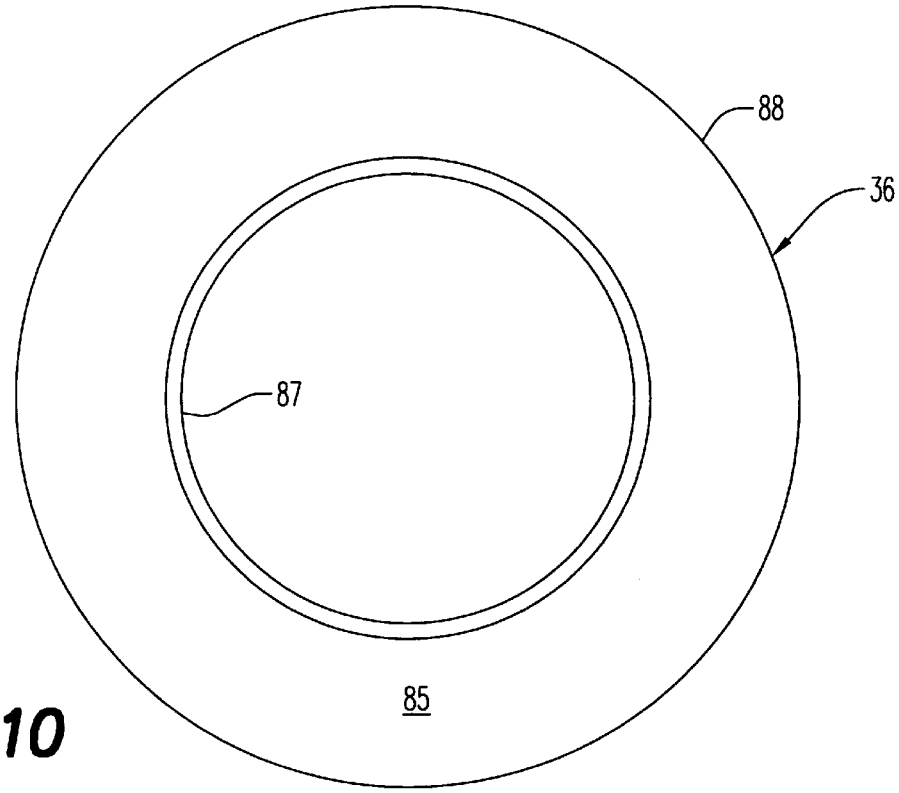
FIG. 10 is a top view of the evaporative pad shown in FIG. 9.
Figure 9:
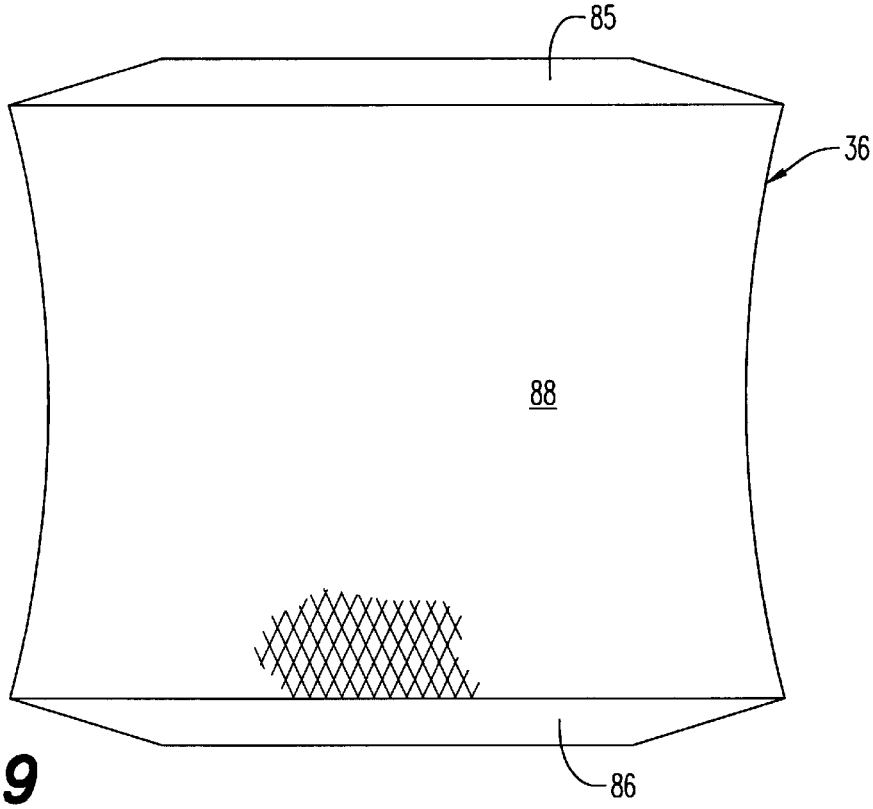
FIG. 9 is an elevational view of an evaporative pad used in the humidifier shown in FIGS. 1–3.

Referring now to FIGS. 9 and 10, the evaporator pad 36 is a hollow cylindrical element formed of a suitable water absorbent material typically used in evaporative humidifiers. The pad 36 has a tapered, annular top surface 85 and a tapered, annular bottom surface 86. Extending between inner and outer edges of the top and bottom surfaces 85, 86, are, respectively, a cylindrical, inner side surface 87 and a cylindrical, outer side surface 88. With the pad 36 positioned in the base unit 17 and within the retainer receptacle 37 (FIG. 3), the top surface 85 is vertically aligned with the annular vessel 75 formed by the liquid distribution assembly 58 and with the liquid openings 78 therein.

Upon energization of the motor 47, the fan blade 52 rotates to produce air flow in the air flow path 28 between the inlets 20, 24, 25 and the outlet 26. The airflow path 28 includes a transverse path section 91 defined between the housing 16 and the outer side surface 88 of the evaporator pad 36 and an axial path section 92 defined by the inner cylindrical side surface 87 of the evaporator pad 36, the upwardly projecting sleeve 84 on the distribution assembly 58 and the tubular portion 42 on the mounting unit 41. Thus, air is drawn in through the inlets 20, 24, and 25 and circulates through the transverse path section 91, the evaporator pad 36 and the axial path section 92 before being discharged into the surrounding environment through the outlet 26.

Simultaneous rotation of the conical pump 57 draws water out of the reservoir 31 through the intake orifice 53 for discharge through the upper orifices 56 into the closed chamber 76 of the distribution assembly 58. Water accumulated in the closed chamber 76 drains through the downwardly sloping, radial tubes 67, 71 into the annular vessel 75 and then through the openings 78 onto the upper surface 85 of the evaporator pad 36. The water flow is sufficient to saturate the evaporator pad 36 with moisture which is collected by the air flow circulating in the air flow path 28 and then discharged into the environment through the outlet 26. Excess water not collected by the air flow migrates down the pad 36 and drops from its lower surface 86 into a catch basin 95 formed in the base unit 17 and communicating with the reservoir 31.

Figure 11:
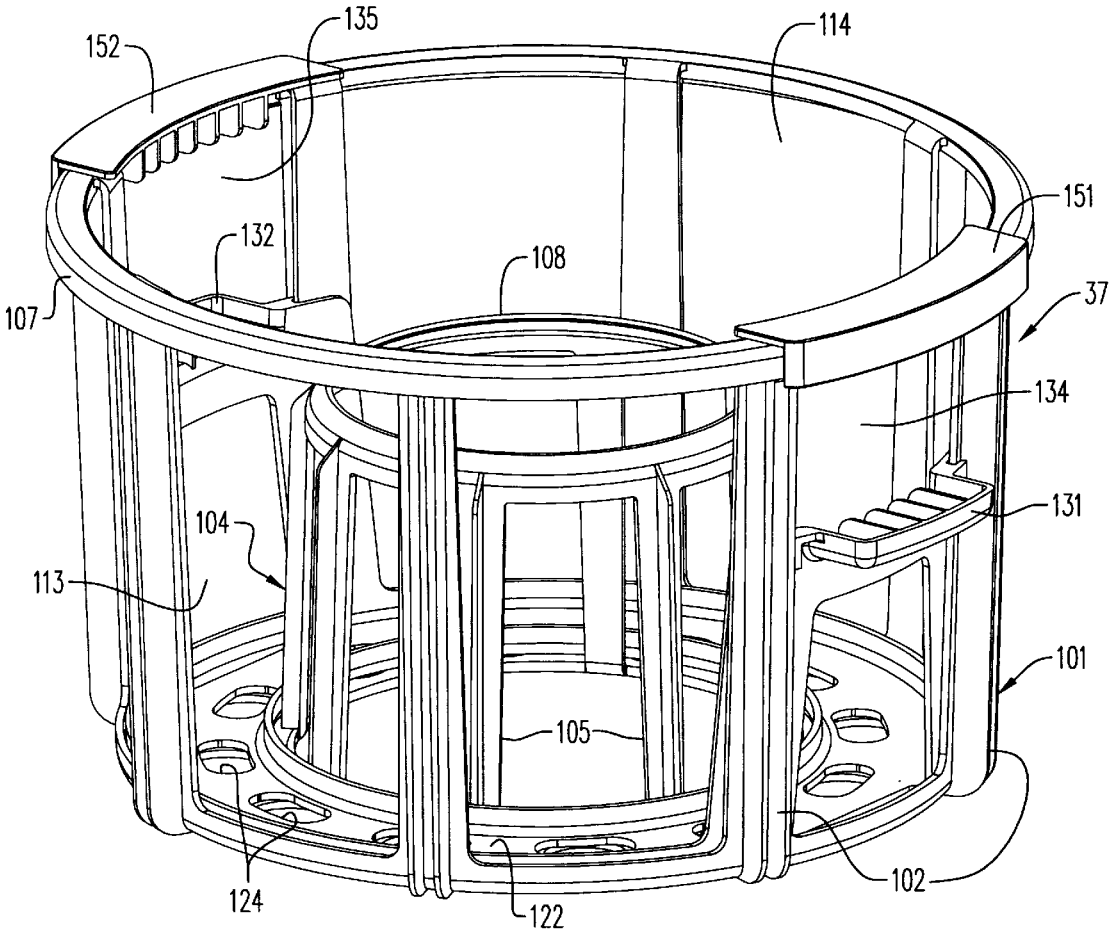
FIG. 11 is a perspective view of a retainer receptacle for the evaporative pad shown in FIGS. 9 and 10.
Figure 12:
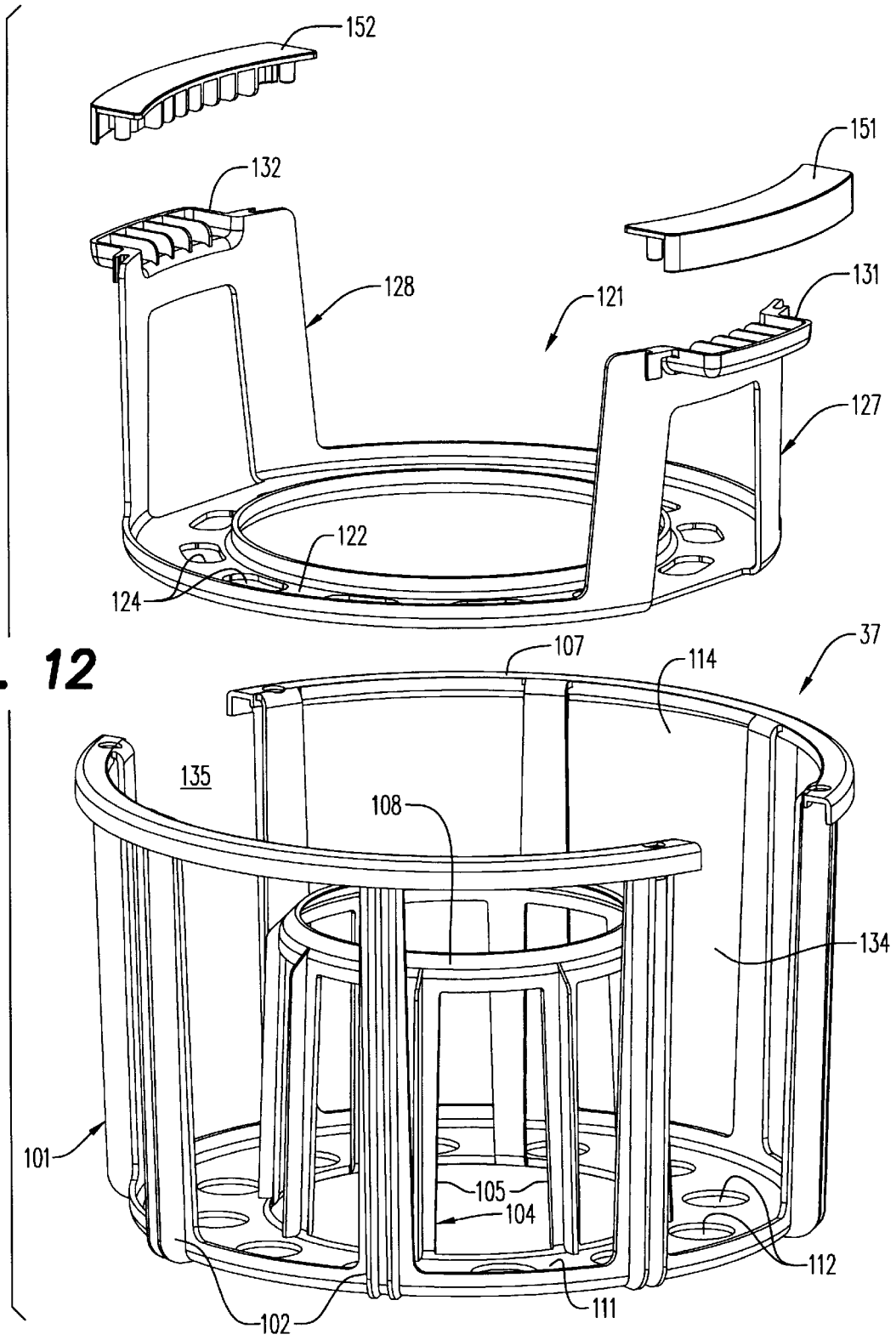
FIG. 12 is an exploded perspective view of the retainer receptacle shown in FIG. 11.

Referring now to FIGS. 11 and 12, there is shown in greater detail the evaporator pad receptacle 37 depicted in FIG. 3. Forming the receptacle 37 are an outer cylindrical wall 101 formed by a plurality of circumferentially spaced apart, vertical members 102 and a coaxial, inner cylindrical wall 104 formed by a plurality of circumferentially spaced apart, vertical members 105. Joining upper ends of the vertical members 102 and 105, respectively, are upper annular rims 107 and 108. Bottom ends of the vertical members 102, 105 are joined, respectively, to outer and inner edges of an annular bottom wall 111 for supporting the evaporator pad 36 and having circumferentially spaced apart air openings 112. The outer and inner side walls 101, 104 define an annular cavity 113 having an open upper end 114 for receiving the evaporator pad 36. As shown in FIG. 11, the vertical members 105 of the inner side wall 104 are shorter than the vertical members 102 of the outer side wall 101 such that the upper rim 108 is downwardly spaced from the upper rim 107.

Movably mounted in the cavity 113 is an ejector mechanism 121 (FIG. 12) movable to eject an evaporator pad 36 from the receptacle 37. The ejector mechanism 21 includes an annular plate 122 supported by the bottom wall 111 of the receptacle 37 and movable in the cavity 113 in a direction toward the open end 114. Defined by the plate 122 are circumferentially spaced apart apertures 124 aligned with the openings 112 in the bottom wall 111 of the receptacle 37. A pair of bifurcated struts 127 and 128 extend upwardly from diametrically opposed positions on the outer edge of the annular plate 122. Upper ends of the struts 127, 128 support first and second handles 131, 132 which project, respectively, through first and second slots 134, 135 formed in the outer side wall 101 between adjacent pairs of the vertical members 102. The handles 131 and 132 can be manually manipulated to slide the ejector plate 122 upwardly in the cavity 113 toward the open end 114.

After the evaporative humidifier 115 has been operated for a given time period, the evaporator pad 36 can become clogged with particulate matter circulated by the air flow. Such clogging reduces normal humidifier throughput which can be restored by replacement of the evaporator pad 36. To effect replacement, the combined liquid distribution and blower system assemblies 38 and 39 are withdrawn from the housing 16 by lifting the mounting unit 41 out of the opened cover 18. Removal of the assemblies 38, 39 provides access to the retainer receptacle 37 which together with a clogged evaporator pad 36 then also can be removed from the housing 16. After such removal, the handles 131, 132 are gripped and moved upwardly in the first and second slots 134, 135 causing corresponding movement of the ejector plate 122 upwardly in the cavity 113 toward the open end 114. The ejection movement continues until the handles 131, 132 engage bridge members 151,152 which are attached to the upper rim 107 of the outer side wall 101 and close the upper ends of the first and second slots 134, 135. During the ejection operation, the receptacle 37 preferably is held in an inverted orientation over a suitable trash container (not shown) positioned to receive the clogged evaporator pad 36 which is ejected from the receptacle 37 by the movement of the engaging ejector plate 122. The reduced height of the inner side wall 104 is such that a full upward stroke of the ejector plate moves the evaporator pad 36 above the upper rim 108. Thus, the retaining pressure previously applied by the inner side wall 104 is eliminated to facilitate ejection of the pad 36 from the receptacle 37.

Obviously, many modifications and variations of the present invention are possible in light of the above teachings. It is to be understood, therefore, that the invention can be practiced otherwise than as specifically described.

What is claimed is:

1. A humidifier comprising:

a housing defining an air inlet, an air outlet, an air flow path between said inlet and said outlet and a liquid reservoir;

a blower system for producing air flow between said inlet and said outlet;

retainer means removably mounted in said housing and shaped and arranged to support a liquid absorbent evaporator pad in said air flow path; and an ejector mechanism movable relative to said retainer means and operable to eject the evaporator pad from said retainer means.

2. A humidifier according to claim 1 wherein said retainer means comprises a porous receptacle arranged to pass air circulating in said air flow path.

3. A humidifier according to claim 2 wherein said receptacle defines air porous side walls, an open upper end for receiving the evaporator pad, and a bottom portion for supporting the evaporator pad.

4. A humidifier according to claim 3 wherein said ejector mechanism is mounted in said receptacle for reciprocating movement in a direction between said bottom portion and said open upper end.

5. A humidifier according to claim 4 wherein said ejector mechanism defines an ejector surface disposed in to engage a bottom surface of the evaporator pad.

6. A humidifier according to claim 5 wherein said ejector mechanism includes handle means manipulatable to produce said reciprocating movement.

7. A humidifier according to claim 6 wherein said ejector surface is substantially co-extensive with a said bottom portion of said receptacle.

8. A humidifier according to claim 1 wherein said retainer means comprises a receptacle having co-axial inner and outer cylindrical side walls defining an annular cavity with an open upper end for receiving an annular evaporator pad and a bottom portion for supporting the evaporator pad.

9. A humidifier according to claim 8 wherein said inner and outer side walls are porous and arranged to pass air circulating in said air flow path.

10. A humidifier according to claim 9 wherein said air flow path includes an axial section at least partially defined by said inner cylindrical side wall, and a transverse section communicating with said outer cylindrical side wall.

11. A humidifier according to claim 10 wherein said ejector mechanism is mounted in said receptacle for reciprocating movement in a direction between said bottom portion and said open upper end.

12. A humidifier according to claim 11 wherein said ejector mechanism defines an ejector surface disposed in to engage a bottom surface of the evaporator pad.

13. A humidifier according to claim 12 wherein said ejector mechanism includes handle means manipulatable to produce said reciprocating movement.

14. A humidifier according to claim 13 wherein said ejector surface is substantially co-extensive with a said bottom portion of said receptacle.

15. A humidifier according to claim 14 wherein said bottom portion is an annular bottom wall extending between bottom edges of said inner and outer side walls.

16. A humidifier according to claim 15 wherein said ejector mechanism includes an annular plate supported by said bottom wall and movable toward said open end between said inner and outer side walls.

17. A humidifier according to claim 16 wherein said outer side wall defines diametrically spaced apart first and second slots; and said handle means comprises a first handle secured to said plate and extending through said first slot, and a second handle secured to said plate and extending through said second slot.

18. A humidifier according to claim 17 wherein said bottom wall and said plate are porous.

19. A humidifier according to claim 18 wherein said bottom wall defines circumferentially spaced apart openings, and said plate defines circumferentially spaced apart apertures aligned with said openings.

20. A humidifier according to claim 19 wherein each of said inner and outer side walls includes an annular upper rim; and a plurality of circumferentially spaced apart, substantially vertical members extending between said upper rim and said bottom wall.

21. A humidifier according to claim 20 wherein said inner side wall has a height substantially shorter than said outer side wall.

* * * * *